US008733837B2

(12) United States Patent
Weinstein et al.

(10) Patent No.: US 8,733,837 B2
(45) Date of Patent: May 27, 2014

(54) FURNITURE COVER

(75) Inventors: Bernard Weinstein, Markham (CA); Anita Aruajo, Markham (CA); Karolin Belashkin, Markham (CA); Nilvi Surrinder, Markham (CA)

(73) Assignee: Caber Sure Fit Inc., Ontario (CA)

( * ) Notice: Subject to any disclaimer, the term of this patent is extended or adjusted under 35 U.S.C. 154(b) by 0 days.

(21) Appl. No.: 13/355,012

(22) Filed: Jan. 20, 2012

(65) Prior Publication Data

US 2013/0187420 A1 Jul. 25, 2013

(51) Int. Cl.
*A47C 31/11* (2006.01)

(52) U.S. Cl.
USPC ..... 297/229; 297/228

(58) Field of Classification Search
USPC ..... 297/219.12, 218.1, 227, 225, 229, 228, 297/219.1
See application file for complete search history.

(56) References Cited

U.S. PATENT DOCUMENTS

| | | | | |
|---|---|---|---|---|
| 2,800,169 | A * | 7/1957 | Armbrecht | 297/225 |
| 4,824,168 | A * | 4/1989 | Makoski | 297/229 |
| 5,809,595 | A * | 9/1998 | Stevens et al. | 5/653 |
| D465,959 | S * | 11/2002 | Cameron | D6/611 |
| 6,848,743 | B1 * | 2/2005 | Collins | 297/256.17 |
| 7,878,587 | B1 * | 2/2011 | Leach | 297/219.12 |
| 2001/0048235 | A1 * | 12/2001 | Hartranft | 297/219.12 |
| 2010/0314915 | A1 * | 12/2010 | Mills | 297/188.01 |

OTHER PUBLICATIONS

Cabela's Large Sofa Saver; http://www.cabelas.com/product/Home-Cabin/Dog-Supplies/Dog-Beds%7C/pc/104988; Date of publication unknown but prior to the filing date of the application. 1 page.
Cabela's Quilted Microfiber and Sherpa Fleece Pet Throw; http://www.cabelas.com/product/Home-Cabin/Dog-Supplies/Dog-Beds%7C/pc/104988; Date of publication unknown but prior to the filing date of the application. 1 page.
Plow & Hearth, Multipurpose Throw;http://www.plowhearth.com/product.asp?section_id=0&department=0&Search_type=nor; Date of publication unknown but prior to the filed of the application. 2 pages.
Nextag, Waterproof Sofa Cover-Home & Garden;http://www.nextag.com/waterproof-sofa-cover/stores-html; Date of publication unknown but prior to the filed of the application. 3 pages.
Sure Fit, Pet Furniture Covers; http://www.surefit.net/shop/groups/pet-furniture-covers/; Date of publication unknown but prior to the filed of the application. 1 page.

* cited by examiner

*Primary Examiner* — Milton Nelson, Jr.
(74) *Attorney, Agent, or Firm* — Banner & Witcoff, Ltd

(57) ABSTRACT

A furniture cover is provided that has a substantially t-shaped, substantially continuous, fabric body having a generally elongated central trunk portion, and two outwardly extending arm portions. The central trunk portion is sized to extend over and substantially across the back, seat and front of a seating device. The arm portions are sized to extend over and substantially across the arms of the seating device. The fabric body has a first layer of comfort fabric for exposure to the user; and a second layer of waterproof fabric, seamed around a perimeter edge to the first layer, so that the second layer provides a waterproof barrier across the covered portions of the seating device.

7 Claims, 4 Drawing Sheets

FURNITURE COVER

FIELD OF THE INVENTION

The invention relates to furniture covers for seating devices, and more particularly, relates to waterproof furniture covers.

BACKGROUND OF THE INVENTION

In order to protect upholstered furniture surfaces, there are several alternatives. Stain-resistant upholstery fabrics are available, but these do not provide a fully waterproof barrier. Fluid exposure, such as from spills or incontinence (human or pet), can permanently damage furniture, if the fluid seeps into the foam layer of the furniture.

Slipcovers for furniture have been around for many years. Slipcovers provide a useful alternative to reupholstering furniture, and serve to protect the furniture surface from day to day wear (in addition to allowing the user to change the appearance of furniture items). However, they are not always easy to put on or take off. Also, slipcovers are frequently provided in very specific sizes that are not easily repurposed for another piece of furniture.

Simple throws can be used to drape over furniture as a temporary protection. Such throws may be washable and provide a certain amount of absorbency. However, they are not generally waterproof, and the configuration of a blanket is not ideally suited to covering the contact surfaces of the furniture, and staying in place without wadding or shifting through use.

SUMMARY OF THE INVENTION

A furniture cover is provided that has a substantially t-shaped, substantially continuous, fabric body having a generally elongated central trunk portion, and two outwardly extending arm portions. The central trunk portion is sized to extend over and substantially across the back, seat and front of a seating device. The arm portions are sized to extend over and substantially across the arms of the seating device. The fabric body has a first layer of comfort fabric for exposure to the user; and a second layer of waterproof fabric, seamed around a perimeter edge to the first layer, so that the second layer provides a waterproof barrier across the covered portions of the seating device.

The fabric body may also include a third layer of non-skid fabric, seamed around a perimeter edge to both the first and second layers, to prevent the cover from slipping off a seating device in use (the second layer is sandwiched between the first layer and the third layer).

Many material choices are possible. The first layer may for example be a quilted fabric. It may be an upholstery fabric. It may be a stain-resistant fabric. Preferably, the layers of the fabric body are selected to be washable.

Preferably, the fabric body is continuous between the trunk portion and the arm portions, having no seams between the trunk portion and the arm portions. Preferably, the sections of the central trunk portion and arm portions exposed to the user have no seams. Preferably, there is no seam between the back and the seat.

DETAILED DESCRIPTION

Figure 1:
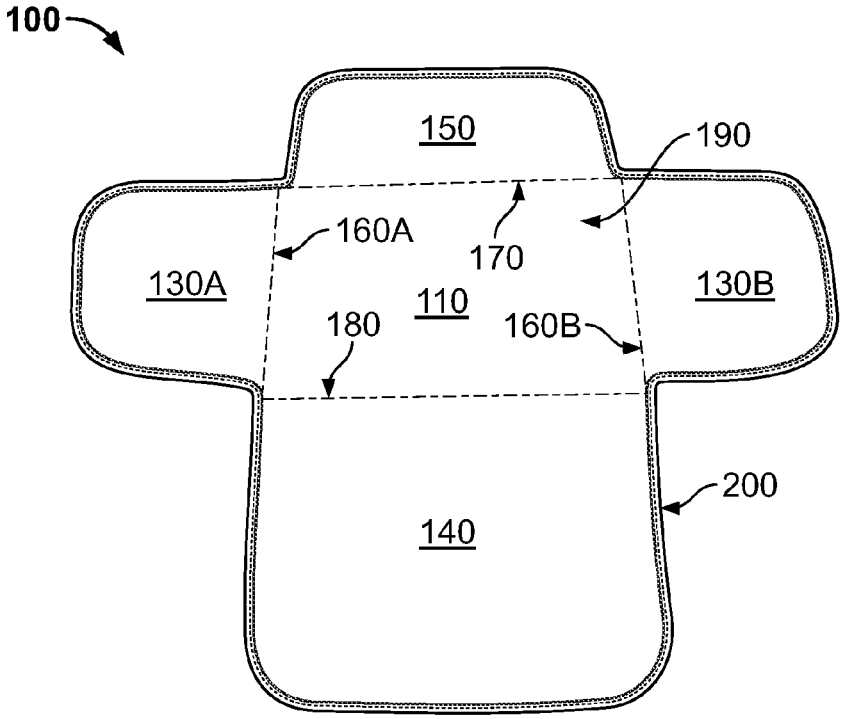
FIG. 1 is a front view of the furniture cover.
Figure 2:
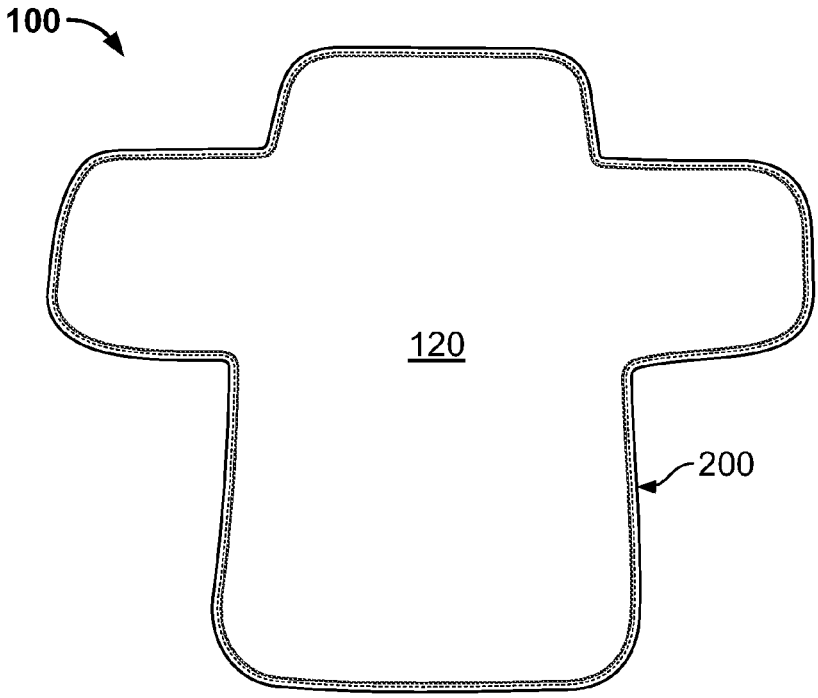
FIG. 2 is a back view of the furniture cover.

The furniture cover 100 has a generally t-shaped (or cross-shaped) body. As shown in FIG. 1, a central trunk portion (made up of sub-portions 150, 110 and 140) has outwardly extending arm portions 130A, 130B. The cover 100 is a continuous unit. The trunk and arm portions are preferably not seamed together but integral.

Figure 3:
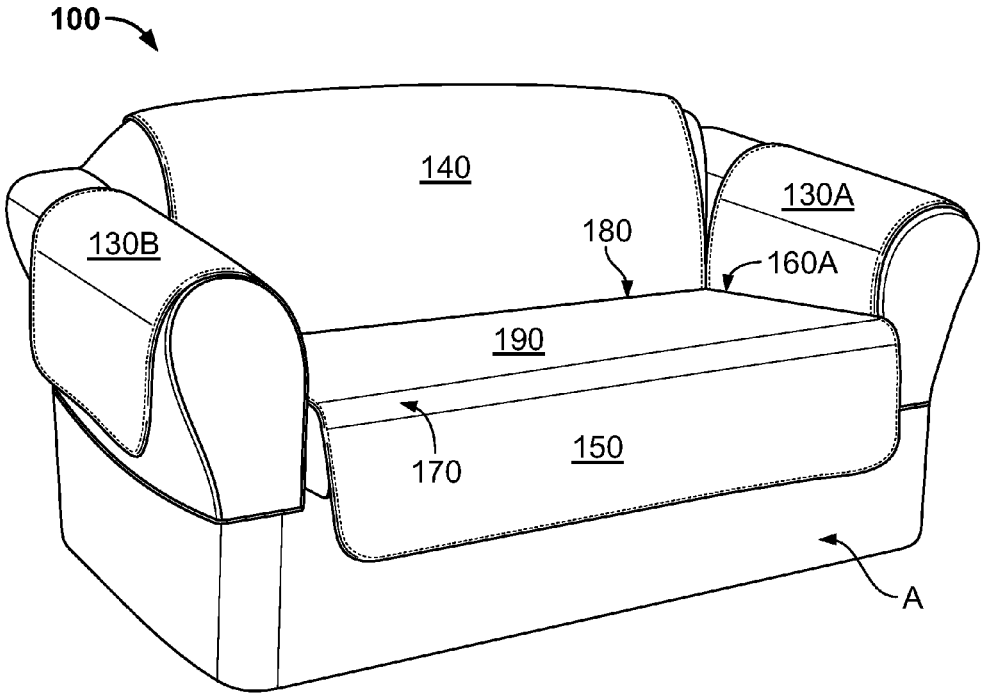
FIG. 3 is a perspective view of the furniture cover in use on a sofa.
Figure 4:
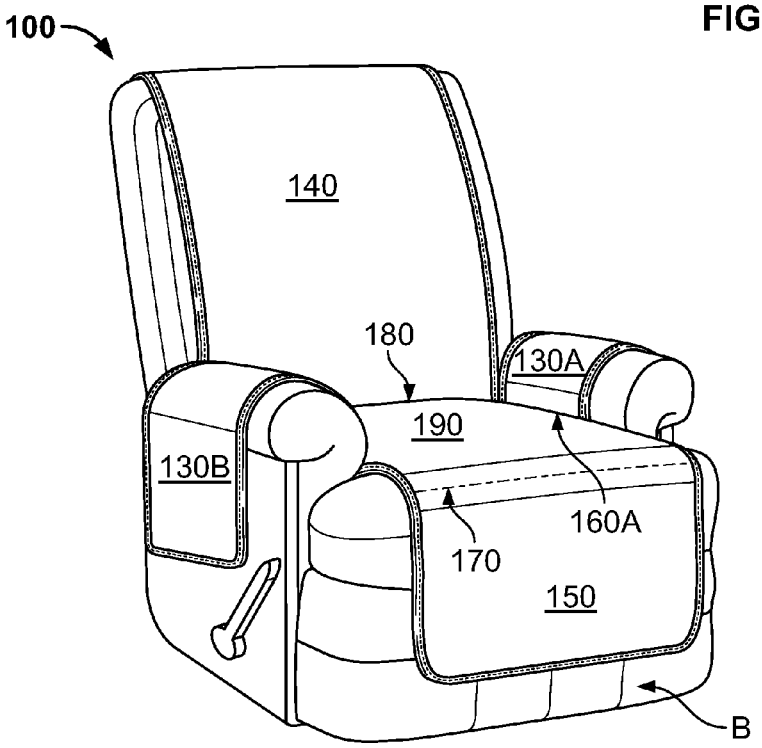
FIG. 4 is a perspective view of the furniture cover in use on a chair.

The central trunk portion is made up of portion 110, portion 150, and portion 140. The functional purpose of each of these portions is best seen in FIGS. 3 and 4, wherein the cover 100 is shown draped on a sofa A and chair B, respectively. Portion 140 is the relatively longest portion of the cover 100. From the seat surface, portion 140 extends up and over the back of the sofa/chair to terminate at a point behind the sofa/chair back. The exact reach is immaterial since the point of the cover is not to encase or "slipcover" the furniture item, but simply to protect the contact surfaces (in contact with the user as s/he sits or lies on the sofa/chair).

Portion 190 extends across the seat of the seating device where the user sits (i.e. under the user's seat).

Portion 150 extends from portion 190 and hangs down at least a portion of the front edge of the sofa/chair (notionally under/behind the user's legs when the user is in a seated position). Portion 150 need not precisely cover the entire front surface of the sofa/chair so long as the contact areas are covered.

Arm portions 130A, 130B extend out from portion 190 to drape up and over the arms of the sofa/chair. On an armless sofa/chair, these portions may simply hang down the sides of the sofa/chair to provide another covered (lower) surface (not shown).

Figure 5:
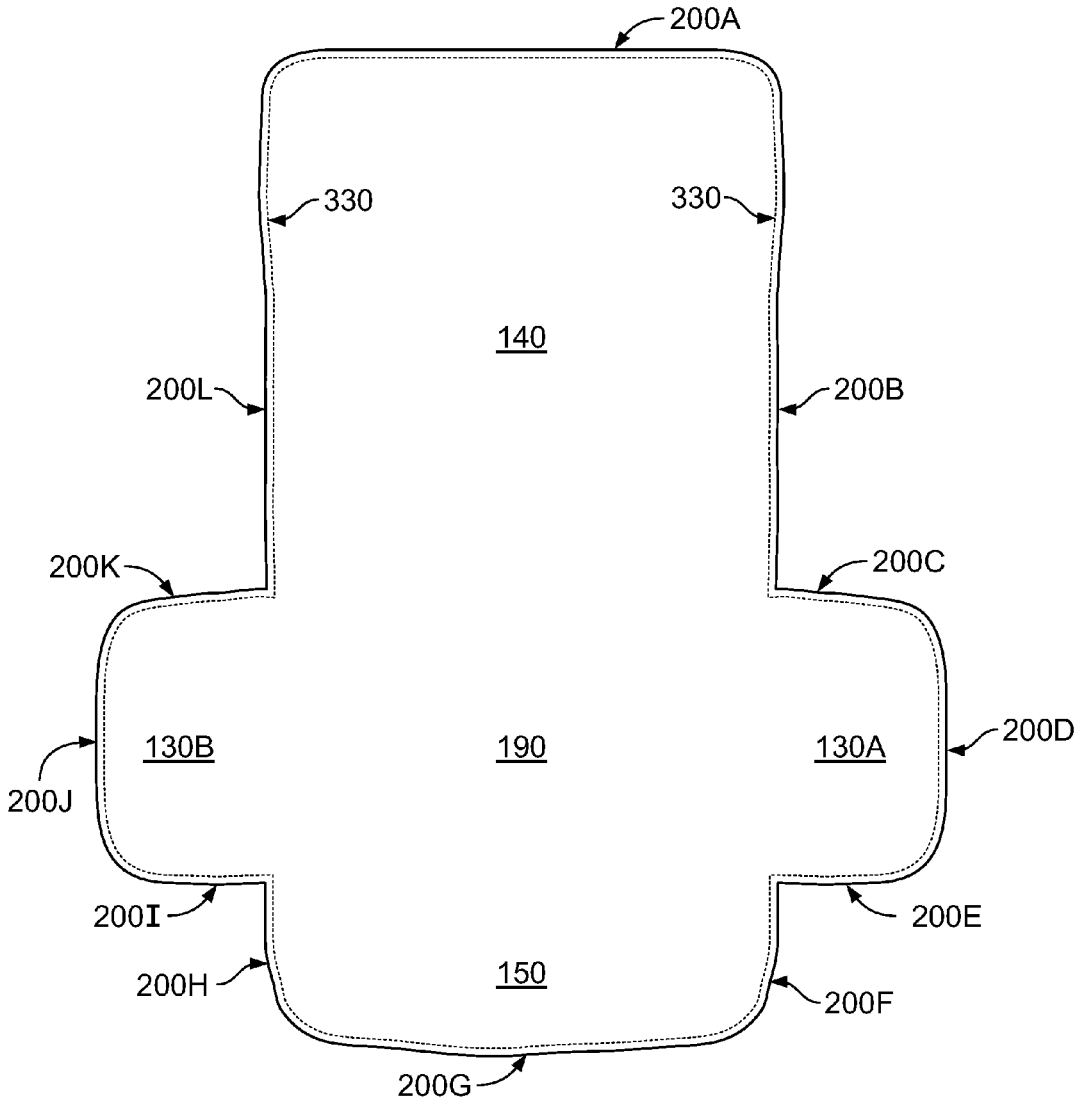
FIG. 5 is a front view of the furniture cover outline to show perimeter segments and stitching.
Figure 6A:
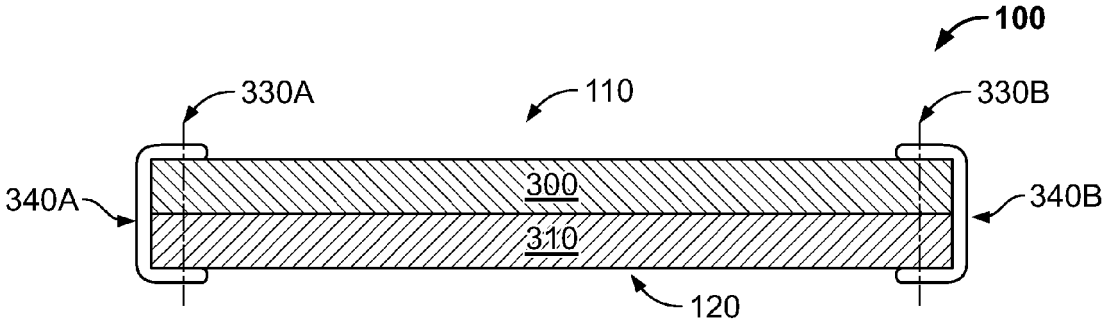
FIG. 6A is sectional view of a two-layer embodiment of the furniture cover.
Figure 6B:
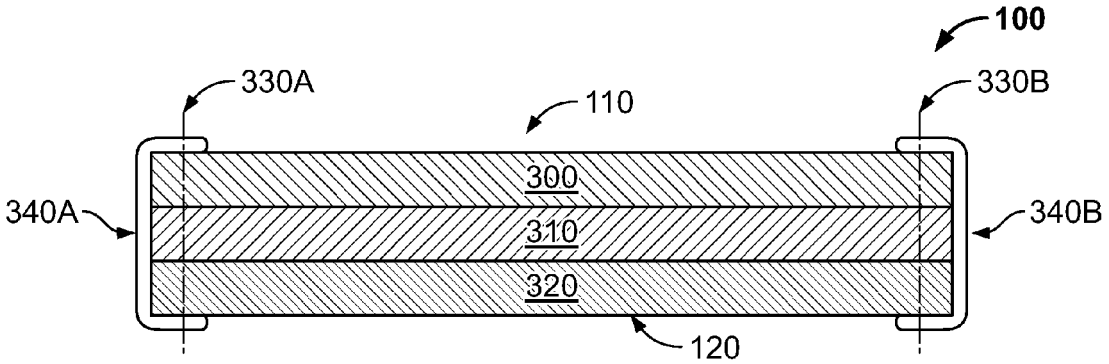
FIG. 6B is a sectional view of a three-layer embodiment of the furniture cover.

The perimeter of the cover is made up of a number of segments as shown in FIG. 5:

- segments 200L, 200A, and 200B bound portion 140 of the cover (which extends up a front face of the back of the seating device and at least partway down a rear face of the back of the seating device);
- segments 200C, 200D, and 200E bound portion 130A of the cover (which extends across a first arm of the seating device);
- segments 200F, 200G, and 200H bound portion 150 of the cover (which extends down the front of the seating device); and
- segments 200K, 200J, and 200I bound portion 130B of the cover (which extends across a second arm of the seating device).

The joints 170, 160A-B, 180 between the portions 110, 130A-B, 140 and 150 of the cover 100 are delineated in FIGS. 1, 3, and 4, simply for ease of reference and to illustrate exemplary fold lines. However, these joints are notional only. No seam or other physical joint occurs at these locations on an actual cover.

The cover 100 has a layered construction. The top layer (first layer) is a comfort fabric (e.g. polyester, cotton, microfiber, Tencel™, rayon, or blends or weaves of the above). It may be an upholstery-type fabric. It may be a quilted fabric. It may be inherently stain-resistant or treated with a stain-resisting treatment. The fabric may be breathable and porous. The under layer (second layer) is a waterproof textile, such as TPU (i.e. thermoplastic polyurethane), or PVC (polyvinyl chloride), or PE (polyethylene). TPU is a presently preferred textile for this purpose since it breathes. Importantly, the first and second layers are preferably seamed together only at or near their perimeter edges. The waterproof layer is not quilted to the top layer. This is to ensure a continuous waterproof barrier across the contact surfaces of the furniture item. Preferably the layers of the cover are all machine washable/dryable to keep the cover clean and hygienic for maximum user-friendliness.

Optionally, a third layer 320 may be provided behind (under) the second layer. This layer may be a further layer of comfort fabric (making the cover reversible), or it may be a non-skid textile to provide added frictional resistance when in position on the furniture item. This is to resist the user accidentally pulling the cover down in use, or the user slipping (together with the cover) off the furniture item. This latter hazard may be a particular concern for older or reduced mobility users who may tend to "scoot" forward to get up and out of sitting position. Various types of non-skid materials may be used. For use on furniture items with fabric upholstery, the non-skid material may be for example a non-woven fabric (whose rough texture frictionally resists slipping against the texture of the upholstery fabric). For smoother surfaces, such as leather furniture, it may be preferred to use a textile having HotDots™ or similar rubbery texturing. The non-skid may be provided over the entire surface 120 or only certain zones or localized spots.

The perimeter edges of the cover may be finished with trim. The trim pieces (shown notionally in two side portions 340A, 340B) may extend across the top and bottom surfaces of the layered sandwich of the cover and be seamed together. It will be appreciated that the notional seam portions 330A and 330B may in fact be one continuous seam 330, extending around all of the perimeter segments 200A-200L, as shown in FIG. 5. Preferably, the seam is approximately 5-10 mm from the perimeter edge 200 of the cover 100.

Suitable width and length (height) dimensions for the cover will vary depending on the approximate scale of the furniture item to be covered (e.g. wingback, armchair, recliner, loveseat, sofa). For example, an armchair cover may fit armchairs up to approximately 110 cm in width, while a loveseat cover may fit loveseats up to approximately 190 cm in width, and a sofa cover may fit sofas up to approximately 225 cm in width, etc. Length and height may also be a factor. A recliner cover may fit recliners up to 105 cm tall. The overall thickness of the cover is preferably in the range of about 3 mm to over 1 cm (depending on the number of individual layers and their thicknesses). The thickness may also be somewhat variable across the article (e.g. covers with quilted top layers will generally have variable thickness due to the quilting).

It will be appreciated that these dimensions are illustrative only and not essential. It is an advantage of the cover that sizing is very flexible, since the cover does not attach to or surround the furniture item at any point. Further, there is generally no need to provide precise fit so long as the areas of intended contact are covered (e.g. a sofa size cover can be draped over a chair, a chair size cover can be draped over a sofa, etc.). (This flexibility in sizing also makes purchasing easier for customers who may not have accurate measurements of their furniture at hand, and for retailers who can stock only a few standard sizes).

Figure 7:
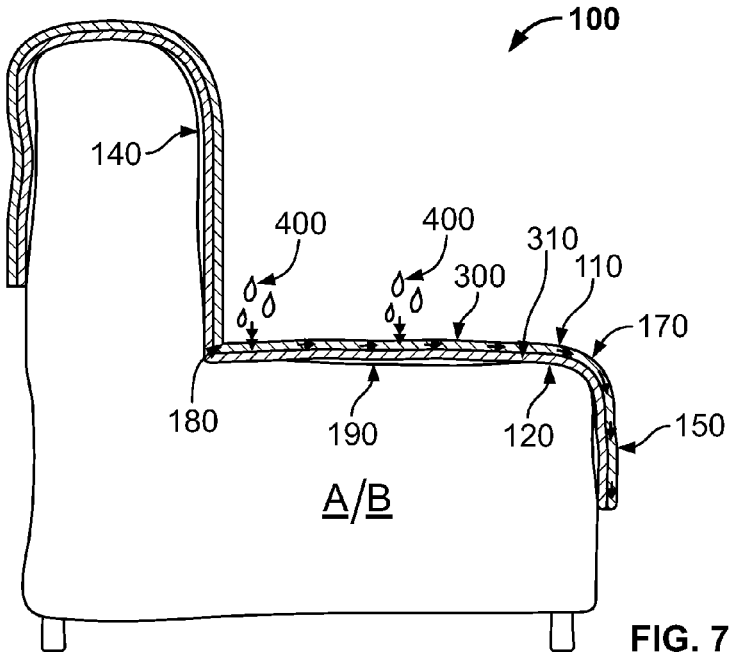
FIG. 7 is a side view of the furniture cover in use on a seating device, showing possible fluid path along the cover.

In use, the cover 100 simply drapes over the furniture item. When a spill or accident occurs, the continuous waterproof barrier of layer 310 prevents the fluid from penetrating to the furniture item itself. The fluid is simply absorbed into the top layer 300 or is wicked away from the surface to run between the first and second layers (as shown in FIG. 7). Fluid entry at creases or corners in the furniture is also not a problem since the lines 180, 170, 160A, 160B of the cover are not seamed. There is no stitch line at these junctures for fluid to penetrate.

The cover 100 protects the contact surfaces of the furniture item. The cover itself also has areas that can be notionally thought of as contact areas. Generally, the contact areas include portions 190, 150; at least the front-facing portion of portion 140 (i.e. the part facing the user as opposed to the part hanging down the back of the furniture item); and at least the inward-facing portions of arm portions 130A, 130B (i.e. the parts facing the user not the parts hanging down the opposite (outside) ends of the sofa/chair arms). The configuration and extent of these "contact areas" may depend on the size and configuration of the furniture item. For example, on a taller-back item, the area of the portion 140 that faces the user will be much greater than on a shorter-back item. The non-contact areas of the cover 100 may include cross-seams (e.g. to join fabric pieces) and may in fact be non-waterproof in these areas, although this is less preferred.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents are intended to fall within the scope of the invention as described and within the scope of the claims. A broad purposive construction of the claim elements is intended. Although specific examples of waterproof, non-waterproof and non-skid materials are provided in the foregoing description, it is not intended to limit the construction to those specific materials but any materials having those general properties should be considered to be encompassed. It will also be appreciated that the "seams" may not necessarily be stitched through with thread in the classical sense but may also include other means of joining the fabric layers (eg. fusing or adhering).

What is claimed is:

1. A furniture cover for a seating device having:

a back, which has a front face and a rear face, a seat, a front, and a pair of arms, the seating device being adapted for a human user to sit or lie on the seating device, such that portions of the seating device are contacted by the user, and such that in a seated position, lower legs of the user contact the front of the seating device, upper legs of the user contact the seat of the seating device, and the back of the user contacts the front face of the back of the seating device, such portions of the seating device being contact portions, the covering comprising:

a substantially t-shaped, substantially continuous, fabric body having a generally elongated central trunk portion, and two outwardly extending opposed arm portions at a point along the central trunk portion such that the fabric body forms a t-shape or cross;

the central trunk portion being sized to extend over and substantially across the back, seat and front of the seating device;

the arm portions each being sized to extend over and substantially across one of the arms of the seating device;

the fabric body having a first layer of comfort fabric; and a second layer of waterproof fabric, seamed around a perimeter edge to the first layer, the second layer providing a waterproof barrier across the contact portions and the arms of the seating device.

2. The furniture cover of claim 1, wherein the fabric body further comprises a third layer of non-skid fabric, seamed around a perimeter edge to both the first and second layers, to prevent the cover from slipping off the seating device in use; the second layer being sandwiched between the first layer and the third layer.

3. The furniture cover of claim 1, wherein the first layer is a quilted fabric.

4. The furniture cover of claim 1, wherein the first layer is of an upholstery fabric.

5. The furniture cover of claim 1, wherein the first layer is a stain-resistant fabric.

6. The furniture cover of claim 1, wherein the layers of the fabric body are selected to be washable.

7. The furniture cover of claim 1, wherein the fabric body is continuous between the central trunk portion and the arm portions, having no seams between the central trunk portion and the arm portions.

* * * * *